United States Patent [19]

Landwerlen

[11] 4,019,454

[45] Apr. 26, 1977

[54] BOAT PLUG APPARATUS

[75] Inventor: Joseph E. Landwerlen, Shelbyville, Ind.

[73] Assignee: J & L Tool & Machine, Inc., Indianapolis, Ind.

[22] Filed: Jan. 23, 1976

[21] Appl. No.: 651,736

[52] U.S. Cl. ..... 114/197; 137/409

[51] Int. Cl.[2] ..... B63B 13/00

[58] Field of Search ..... 114/197, 198, 227, 183 R, 114/183 A; 4/286, 295; 137/409; 9/3

[56] References Cited

UNITED STATES PATENTS

| | | | |
|---|---|---|---|
| 186,533 | 1/1877 | Boldemann | 137/409 |
| 2,478,042 | 8/1949 | Elling | 9/3 |
| 2,655,121 | 10/1953 | Cuneo | 114/197 |
| 3,005,465 | 10/1961 | Whitlock et al. | 137/409 |
| 3,812,810 | 5/1974 | Moeller | 114/197 |

*Primary Examiner*—Stephen G. Kunin

*Assistant Examiner*—Sherman D. Basinger

*Attorney, Agent, or Firm*—Woodard, Weikart, Emhardt & Naughton

[57] ABSTRACT

A boat plug apparatus is described comprising a boat having a circular drain hole at the exterior of the transom, and a ball which is pivotally attached to the transom exterior on both sides of the drain hole. The ball is positioned to be partially contained within the drain hole when acted upon by gravity. When the drain hole is not otherwise sealed, the exterior water pressure forces the ball into the hole and causes the ball to sealingly close the hole, preventing the water from entering the boat. When the boat is moving or is raised out of the water, the ball is free to swing away from the drain hole and water within the boat escapes through the drain hole.

13 Claims, 3 Drawing Figures

BOAT PLUG APPARATUS

BACKGROUND OF THE INVENTION

1. Field of the Invention

This invention relates to devices for closing the drain hole of a boat.

2. Description of the Prior Art

Many boats have a drain hole located in the transom below the water line. When the boat is moving, the water is forced away from the exterior of the transom and away from the drain hole. The drain may then be opened and water within the boat will exit through the drain hole under the force of gravity. The drain hole may also be opened when the boat is out of the water, allowing water within the boat to escape. These drain holes thus provide a simple and easy means for bailing water out of a boat.

A problem with such drain holes is that they must be tightly sealed when the boat is not moving, since they then lie below the water line. There are a number of boat plugs which have been designed specifically to ensure against leakages. Plugs which are sold with a boat are generally of the compressible stopper type as shown in U.S. Pat. No. 3,812,810 issued to Moeller on May 28, 1974. These plugs include a resilient stopper which, when compressed along its longitudinal axis, expands radially and seals the drain hole. These plugs, however, are still subject to leakage at the sealing point between the stopper and the drain hole and around the movable parts. In addition, the plug may leak due to damage or wear, or the plug may simply be lost or its installation omitted.

Other types of drain plugs have been designed which are less susceptible to loss or damage. These generally employ a ball or other plug which is held within the drain hole by some external force such as gravity or spring tension. U.S. Pat. No. 2,990,798 issued to Pribyl on Mar. 14, 1960 discloses a plug which is held by a tension spring. In U.S. Pat. No. 3,188,994, issued to Dawson on Dec. 16, 1963, the spherical plug is held within the drain hole by a magnet. These devices, however, do not operate automatically and can not be used in conjunction with the standard drain plug.

Another type of drain plug is shown in U.S. Pat. No. 2,655,121 issued to Cuneo on Oct. 13, 1953. This plug includes a ball which is affixed to an arm which is hingedly attached to the transom exterior. This device is automatic and can be used with an interior boat plug although its positioning would interfere with a conventional exterior boat plug. This plug, however, has several inherent problems. Being a hinged device it is particularly susceptible to fouling, particularly since it is for use in water. The action of water, salt, and animal or plant growth can easily inhibit the movement of the plug and may prevent the device from sealing the hole sufficiently or from opening automatically. There is the further problem of installing the device so that the ball is positioned within the hole. The limitation of the vertical and horizontal movement of the ball relative the drain hole requires that the ball be accurately positioned to prevent leakage. This restriction favors the use of a short arm to promote accuracy of alignment. Conversely, since the ball is located within the hole by gravity, it is desirable to have the arm as long as possible. This plug thus has the additional disadvantage that either accuracy or positioning force must be sacrificed to some extent. Finally, this plug design is susceptible to misalignment due to wear on the parts, interference by deposits of some type, or by simple physical damage. Under the stresses which occur near this plug, the hinged arm may be deformed. Misalignment resulting from any of the above causes will preclude a tight seal of the hole and will permit water to enter the boat.

SUMMARY OF THE INVENTION

The present invention includes a boat having a circular drain hole in the exterior of the transom and a spherical ball, a part of which is movably positioned within the drain hole by attaching means which pivotally attach the ball to the exterior of the transom on both sides of the drain hole. When the drain hole is not otherwise sealed, the ball is sealingly held within the drain hole by the pressure of the water outside the boat. The ball is also free to move away from the drain hole and allow water inside the boat to drain to the exterior when the boat is moving or is removed from the water.

The present invention provides a boat plug, primarily for back-up or auxiliary purposes, which is secured to the boat and is therefore not susceptible to being lost. The boat plug is attached to the transom on both sides of the drain hole. This ensures that the ball will be located in the proper lateral position relative the drain hole. The device is superior to a hinged design since the ball may be moved laterally without damage to the structural members. The two points of attachment maintain the alignment of the ball with the drain hole and allow the ball to be fastened to the boat by non-rigid members, such as bead chains, without problems of misalignment. These non-rigid members are not easily deformed by the stresses existent in the water near the boat transom. The present invention is also less susceptible to fouling than a hinged device.

It is an object of the present invention to provide a boat plug which will sealingly close a drain hole at the exterior of a boat transom.

It is a further object of this invention to provide a boat plug which is secured to the boat in its operational position.

It is another object of this invention to provide a boat plug apparatus which operates automatically to seal the drain hole when the boat is at rest in the water and to allow the boat to drain when the boat is moving or is removed from the water.

A further object of this invention is to provide a boat plug which is less susceptible to fouling or misalignment than previous boat plugs.

Another object of this invention is to provide a boat plug which may be used in conjunction with either an interior or exterior boat plug as a safety device.

Other objects and advantages of the present invention will become apparent from the following specification when considered in light of the attached drawings.

DESCRIPTION OF THE PREFERRED EMBODIMENT

Figure 1:
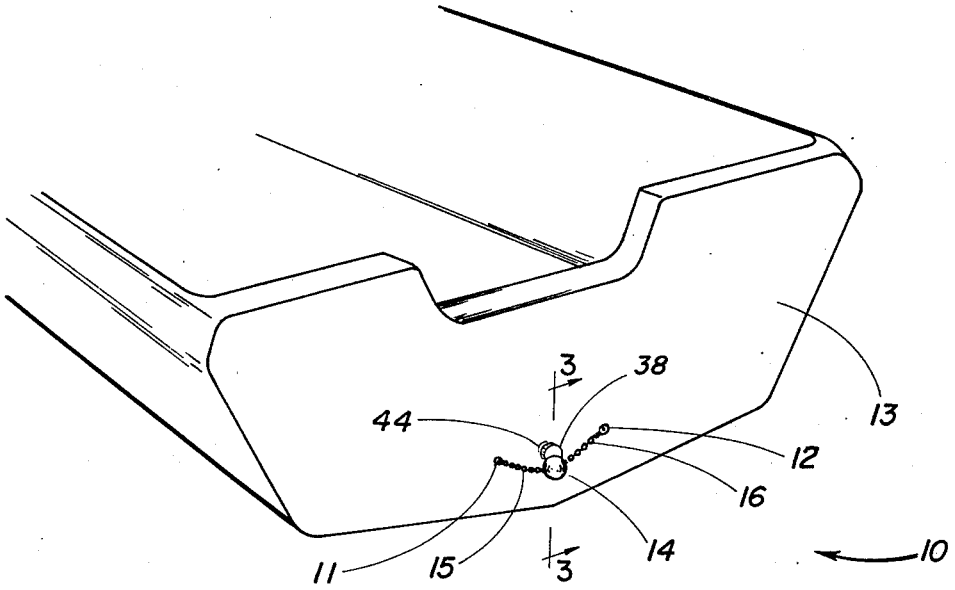
FIG. 1 is a perspective view of the present boat plug apparatus installed upon a boat transom.

For the purposes of promoting an understanding of the principles of this invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring in particular to FIG. 1, there is shown a boat plug apparatus 10 according to the present invention. Apparatus 10 is shown attached to boat transom exterior 13 at points 11 and 12 and includes a spherical ball 14 of a neoprene rubber compound resistant to gasoline, oil, water, sunlight and ozone such as certain rubber compounds used in boat motors. Spherical ball 14 is attached to transom exterior 13 at points 11 and 12 by bead chains 15 and 16, respectively. Apparatus 10 is mounted upon transom 13 so that the ball 14 may be positioned partially fit within the circular orifice 44 of the drain hole. This circular orifice is generally one inch in diameter, and ball 14 would then be about 1⅛ inches diameter, for example.

Figure 2:
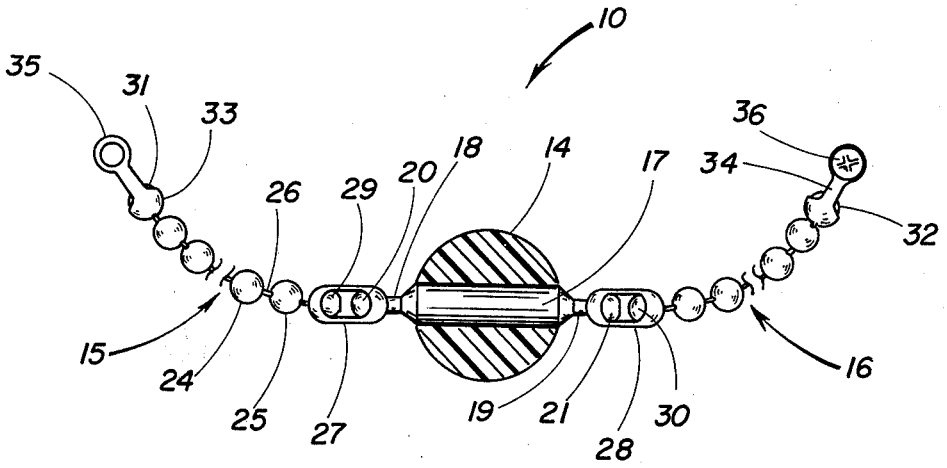
FIG. 2 is a front elevation of the apparatus of this invention shown partially in section for convenience of illustration.

Referring now to FIG. 2, there is shown a front elevational view of apparatus 10, with portions cut away for illustration. Pin 17 passes through the center of ball 14 and is held firmly therein. Pin 17 includes necks 18 and 19 and heads 20 and 21, respectively. Bead chains 15 and 16 include hollow, spherical beads, such as 24 and 25, held together by flanged pins, such as 26. End beads 29 and 30 are rotatably attached to heads 20 and 21 by fastners 27 and 28, respectively.

End beads 31 and 32 are pivotally attached to fasteners 33 and 34, which contain eyelets, such as 35. Fasteners 33 and 34 are affixed to the boat transom 13 by screws such as 36 which are inserted through the eyelets and which have heads larger than the eyelets.

Figure 3:
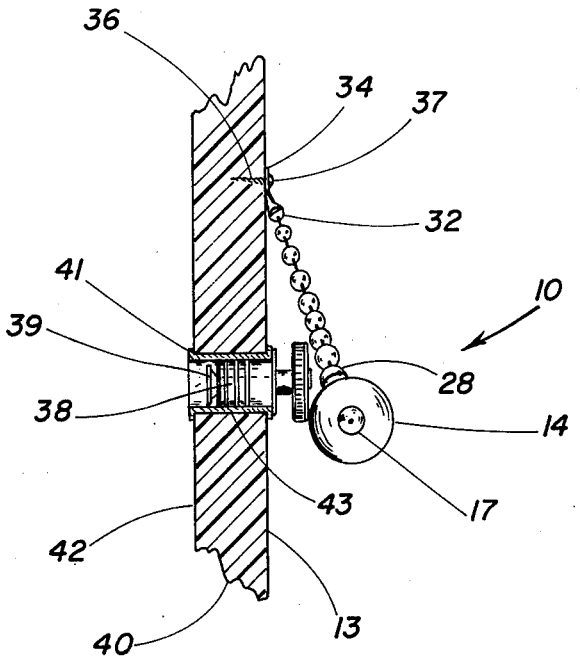
FIG. 3 is a side sectional elevational view of the apparatus of FIG. 1, taken along the line 3—3 and viewed in the direction of the arrows.

Referring now to FIG. 3, there is shown a cross-sectional view taken on line 3—3 of FIG. 1, looking in the direction of the arrows. The apparatus 10 is shown mounted upon transom exterior 13. A primary externally inserted boat plug 38 is shown as it is normally held within drain hole 39.

Drain hole 39 is generally situated in the bottom center of the boat transom 40. Cylindrical collar 41 is contained within a hole in transom 40 and spans from the transom interior 42 to the transom exterior 13. The seam 43 between collar 41 and transom 40 is made watertight.

Primary plug 38 may be alternatively designed for insertion within drain hole 39 from the interior of the boat. If plug 38 is inserted from the interior, the drain plug apparatus 10 of the present invention will prevent leakage due to the absence or malfunction of the boat plug 38. The present invention will also prevent leakage which would result if an exterior primary boat plug was not inserted by the user of the boat before launching or if plug 38 became dislodged by an exterior force such as tree branches in the water. Primary boat plug 38 may be generally of similar design to that disclosed in FIG. 1 of U.S. Pat. No. 3,859,945, issued to Moeller on Jan. 14, 1975. It can be seen that if primary plug 38 is inserted from the exterior of the boat that the bead chains holding ball 14 permit ball 14 to be moved out of the way for insertion of plug 38 and to rest upon plug 38 until and unless dislodgment of plug 38 occurs.

In operation, the omission or dislodgment of primary plug 38 results in an influx of water through opening 44 and into the boat when the boat is in the water. This influx of water almost immediately draws free-swinging ball 14 into opening 44; and, since the ball is sized slightly larger than the opening, ball 14 stops the flow. The continued pressure of the water outside the boat holds ball 14 firmly in place, sealing the opening, until the boat is removed from the water. When the boat is rapidly accelerated, of course, ball 14 may become dislodged from opening 44 when the speed of the boat and its angle of incline will actually result in water within the boat draining through opening 44.

It is to be understood that only the preferred embodiment has been described. Numerous structural modifications and adaptations may be made without departing from the spirit of this invention.

What is claimed is:

1. A boat plug apparatus which comprises:

a boat having an upwardly extending transom, a drain hole located in the lower portion of said transom and having a circular orifice at the exterior of said transom;

an essentially spherical, semi-rigid ball having a diameter larger than the diameter of said circular orifice of said drain hole;

a first attaching means for attaching said ball to the exterior of said transom at a first point above and to one side of said circular orifice, said first attaching means including a first flexible member attached to the first point and connecting said ball to the first point; and, a second attaching means for attaching said ball to the exterior of said transom at a second point on the opposite side of said circular orifice from the first point associated with said first attaching means, said second attaching means including a second flexible member attached to the second point and connecting said ball to the second point, whereby said ball is positioned partially within said circular orifice when water attempts to flow through said drain hole into the boat, causing an essentially water-tight seal between said ball and said circular orifice.

2. The boat plug apparatus of claim 1 in which each of the first and second flexible members comprises an elongated member of the same length as the other elongated member, and said second attaching means attaches said ball to said transom at a second point which is the same distance above said circular orifice as is the first point of attachment of said first attaching means.

3. The boat plug apparatus of claim 2 which comprises the additional element of means for releasably sealing said drain hole including a plug member insertible from the exterior of said circular orifice.

4. The boat plug apparatus of claim 2 in which said ball is made of a material which is relatively inert to gasoline, oil, water, sunlight and ozone.

5. The boat plug apparatus of claim 4 in which said material in neoprene.

6. The boat plug apparatus of claim 2 in which the elongated members of said first and second attaching means are bead chains.

7. The boat plug apparatus of claim 2 in which the elongated member of said first attaching means is attached to said ball at a point opposite the point on said ball at which the elongated member of said second attaching means is attached.

8. The boat plug apparatus of claim 7 which additionally comprises:

a rod which passes through the center of said ball and is held firmly therein, said elongated members of said first and second attaching means being attached to the opposite ends of said rod.

9. The boat plug apparatus of claim 8 in which:

said ball is made of neoprene said elongated members of said first and second attaching means comprise bead chains, and, said circular orifice has a diameter of about one inch and said ball has a diameter of about 1⅛ inches.

10. The boat plug apparatus of claim 2 in which said circular orifice has a diameter of about one inch and said ball has a diameter of about 1⅛ inches.

11. The boat plug apparatus of claim 1 in which the first and second points are spaced apart a distance greater than the diameter of said ball.

12. The boat plug apparatus of claim 1 in which the first and second flexible members each span from the first and second points, respectively, to said ball.

13. The boat plug apparatus of claim 1 in which the first and second flexible members are bead chains.

* * * * *